US007175061B2

(12) United States Patent
Dohn

(10) Patent No.: US 7,175,061 B2
(45) Date of Patent: Feb. 13, 2007

(54) BELT SUPPORTED CARRIER

(76) Inventor: Matthew Dohn, 901 Pleasant Ave., Auburn, AL (US) 36830

( * ) Notice: Subject to any disclaimer, the term of this patent is extended or adjusted under 35 U.S.C. 154(b) by 346 days.

(21) Appl. No.: 10/639,750

(22) Filed: Aug. 11, 2003

(65) Prior Publication Data

US 2004/0045992 A1 Mar. 11, 2004

Related U.S. Application Data

(60) Provisional application No. 60/409,864, filed on Sep. 11, 2002.

(51) Int. Cl.
*A45F 5/00* (2006.01)

(52) U.S. Cl. ..... 224/673; 224/680; 224/268; 224/241; 224/678; 224/904

(58) Field of Classification Search ..... 224/673, 224/672, 671, 680, 268, 269, 270, 930, 660, 224/663, 665, 676, 241, 191, 197, 904; 248/339, 248/294.1, 240.4, 308
See application file for complete search history.

(56) References Cited

U.S. PATENT DOCUMENTS

| | | | | | |
|---|---|---|---|---|---|
| 409,239 | A | | 8/1889 | Roller | |
| 938,998 | A | * | 11/1909 | Evans | 248/308 |
| 2,071,257 | A | * | 2/1937 | Hansen | 248/294.1 |
| 2,423,531 | A | * | 7/1947 | Theis | 224/182 |
| 2,498,428 | A | * | 2/1950 | Kruse | 108/135 |
| 2,526,768 | A | * | 10/1950 | Pendergrass | 224/182 |
| 2,603,134 | A | * | 7/1952 | Burnam | 224/185 |
| 2,738,909 | A | * | 3/1956 | Shadoin et al. | 224/615 |
| 3,638,843 | A | * | 2/1972 | Ortynski | 224/199 |
| D275,527 | S | | 9/1984 | Gee | |
| 4,790,461 | A | * | 12/1988 | Stover | 224/241 |
| 5,620,121 | A | * | 4/1997 | Watson | 224/272 |
| 5,687,892 | A | | 11/1997 | Johns | |
| 5,810,232 | A | * | 9/1998 | Meurer et al. | 224/677 |
| 5,826,763 | A | * | 10/1998 | Roberts | 224/270 |
| 5,842,620 | A | * | 12/1998 | Koudakis | 224/673 |
| 5,884,876 | A | * | 3/1999 | Axford | 248/48.2 |
| 6,053,383 | A | * | 4/2000 | Gunderson | 224/270 |
| 6,062,449 | A | | 5/2000 | Kahn | |
| 6,199,736 | B1 | | 3/2001 | Musarella et al. | |
| D443,135 | S | | 6/2001 | Marks et al. | |

(Continued)

FOREIGN PATENT DOCUMENTS

JP 2000004942 A * 1/2000

*Primary Examiner*—Nathan J. Newhouse
*Assistant Examiner*—Justin M. Larson
(74) *Attorney, Agent, or Firm*—Emrich & Dithmar

(57) ABSTRACT

A hook-like carrier adapted for attachment to and support by the belt of a user includes an attachment member having a pair of generally vertical, spaced slots which are adapted to receive the user's belt. Attached to an outer portion of the attachment member is a first element of a foldable hook. The first hook element is pivotally coupled to a second hook element such as by a first hinge and the second hook element is, in turn, pivotally coupled to a third hook element, such as by a second hinge. The hook elements are pivotally movable between a first folded configuration, such as when not in use, and a second extended configuration for engaging and supporting an article and maintaining the article securely in position in closely spaced relation to the user's waist.

17 Claims, 4 Drawing Sheets

U.S. PATENT DOCUMENTS

| | | | | |
|---|---|---|---|---|
| D452,435 | S | 12/2001 | Lichter | |
| 6,402,111 | B1 * | 6/2002 | Stewart et al. | 248/317 |
| 6,508,390 | B1 * | 1/2003 | Karpati | 224/270 |
| 2001/0004987 | A1 * | 6/2001 | Armour | 224/270 |
| 2003/0024959 | A1 * | 2/2003 | Armstrong | 224/148.4 |
| 2003/0160075 | A1 * | 8/2003 | Musarella et al. | 224/269 |
| 2004/0104325 | A1 * | 6/2004 | Ay | 248/308 |

* cited by examiner

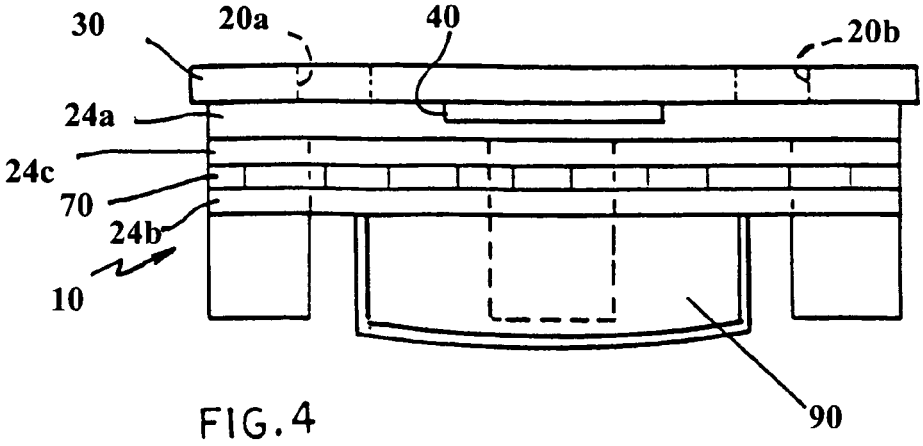
FIG. 4
FIG. 5
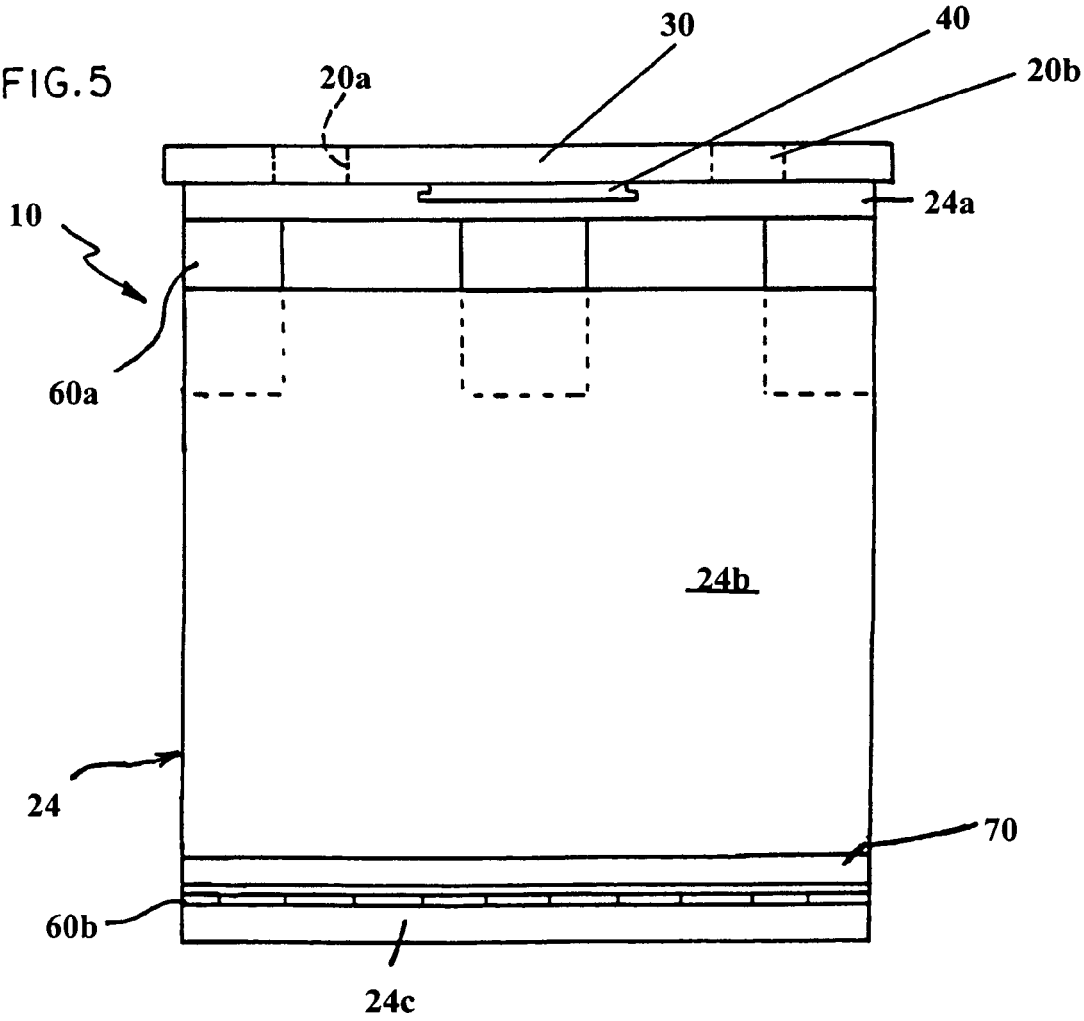

BELT SUPPORTED CARRIER

This application claims the benefit of U.S. Provisional Application No. 60/409,864 filed on Sep. 11, 2002.

FIELD OF THE INVENTION

This invention relates generally to apparatus for engaging and carrying an article and is particularly directed to a device worn on the belt of a user and foldable between a retracted, non-use position and an extended, use position for engaging and supporting an article such as a tool, bucket, roll of wire, etc.

BACKGROUND OF THE INVENTION

Tool belts used by workers typically include various arrangements for attaching and supporting articles which the worker uses in carrying out his or her tasks. These support arrangements may be as simple as a loop attached to, or extending from, the belt for supporting various tools such as a hammer, wrench, screw driver, etc. More complicated hook-like arrangements may also be attached to the belt for supporting heavier objects or an article other than a tool which is being used by the worker. Such other types of articles may include a bucket, a roll of wire, a container of nails, a roll of tape, etc. When the carrier arrangement is formed integrally with the belt, it is typically comprised of cloth or leather. Because of the flexibility of cloth and leather, it sometimes is difficult to either insert an article in the loop-shaped attachment or to remove an article therefrom, particularly when the worker has only one hand available. Other arrangements include a hook-like member removably attached to the belt. Examples of this latter arrangement can be found in U.S. Pat. Nos. 5,687,892; 5,743,451; 6,199,736; 409,239; Des. 275,527; Des. 443,135; and Des. 452,435. U.S. Pat. No. 6,062,449 discloses a tool tote including a rigid hook-like member attached to the belt by means of a clip, with the hook-like member and clip connected by means of a swivel element which allows the hook-like member to be rotatively repositioned for comfort and accessibility. In all of the above-listed arrangements, the article engaging support element includes a rigid hook-like member which cannot be reconfigured when not in use, nor adjusted in position to accommodate various sizes and configurations of a supported article.

The present invention addresses the aforementioned limitations of the prior art by providing a belt supported carrier for an article such as a tool for use by a worker which is easily attached to and removed from the worker's belt, is easily accessed by the worker for attaching or removing a tool, is movable between an extended, use configuration and a compact, non-use configuration, and is inexpensively manufactured, durable and easy to use.

OBJECTS AND SUMMARY OF THE INVENTION

Accordingly, it is an object of the present invention to provide a belt tote device for carrying an article which is foldable between a compact, retracted configuration and an extended use configuration.

It is another object of the present invention to provide a tote device for supporting an article which is attached to the belt of a user and which is vertically adjustable to support various items over a wide range of heights, or positions, on the user's hip.

Yet another object of the present invention is to provide an adjustable, retractable tote device attached to the belt of a user for carrying an article such as a tool, a tape measure, a roll of wire, a container of nails or screws, etc.

A further object of the present invention is to provide a tool-belt tote device which is reliable, easy to use, of simple, sturdy construction, and economical to manufacture.

A still further object of the present invention is to provide apparatus adapted for attachment to the belt of a user which is capable of supporting a heavy object while preventing the object from contacting the user and inhibiting the user's movement or the user's ability to perform a task.

The present invention contemplates apparatus worn by a person for carrying an article. The apparatus comprises an attachment member engaging and supported by a belt worn by the person; a foldable hook structure; a coupling arrangement for pivotally connecting the hook structure to the attachment member, wherein the hook structure is moveable between a retracted, folded position, wherein the hook structure is positioned in closely spaced relation to the attachment member, and an extended, unfolded position, wherein the hook structure extends outwardly from the attachment member for engaging and supporting an article.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 4 is a top plan view of the belt supported carrier of the present invention shown in the folded, or non-use, configuration; and FIG. 5 is a top plan view of the belt supported carrier of the present invention shown in the extended, or use, configuration.

DETAILED DESCRIPTION OF THE PREFERRED EMBODIMENTS

Figure 1:
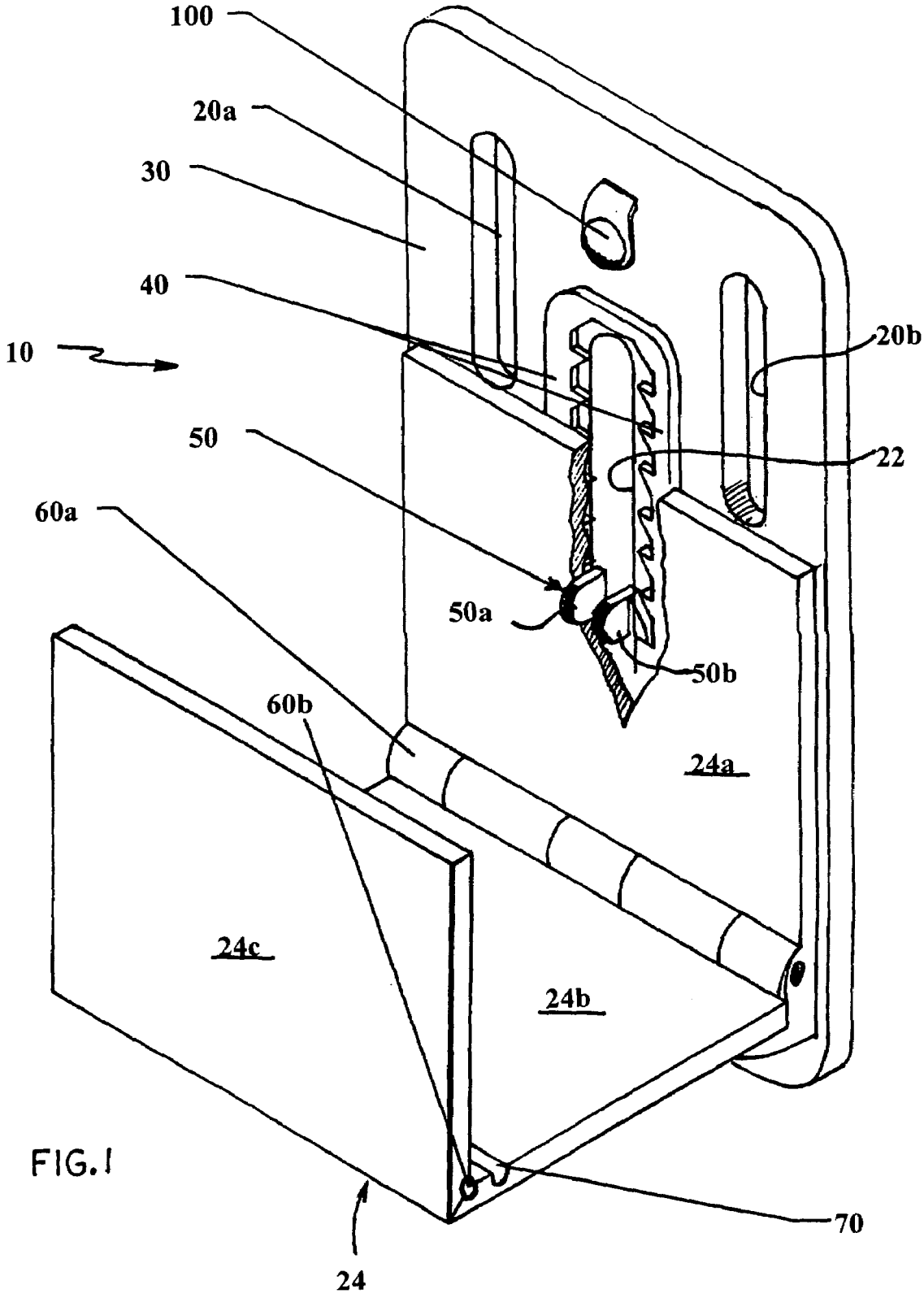
FIG. 1 is perspective view of a belt supported carrier shown in the extended, use configuration in accordance with the principles of the present invention.
Figure 2:
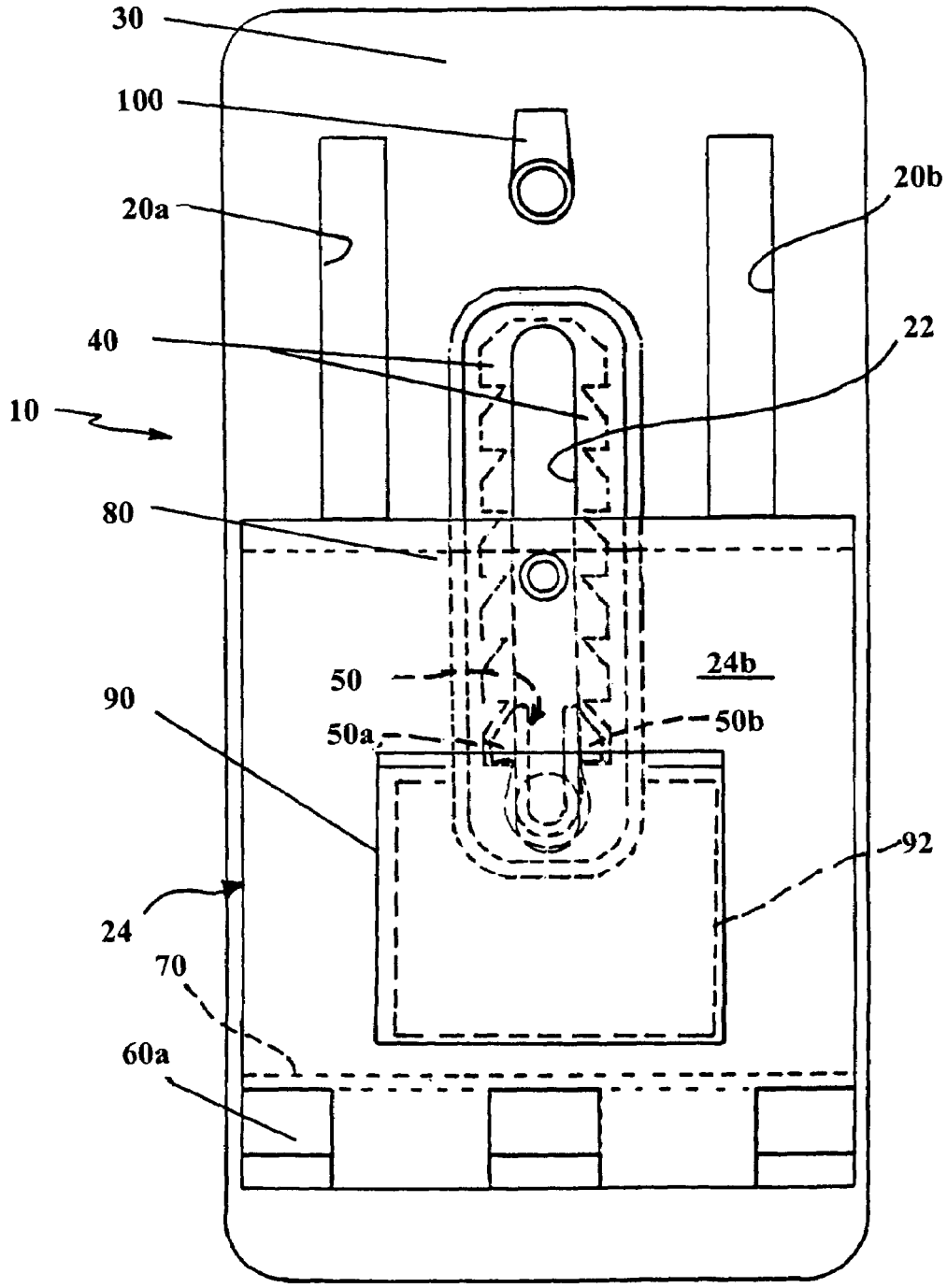
FIG. 2 is a front elevation view of the belt supported carrier of the present invention shown in the retracted, or folded, configuration when not in use.
Figure 3:
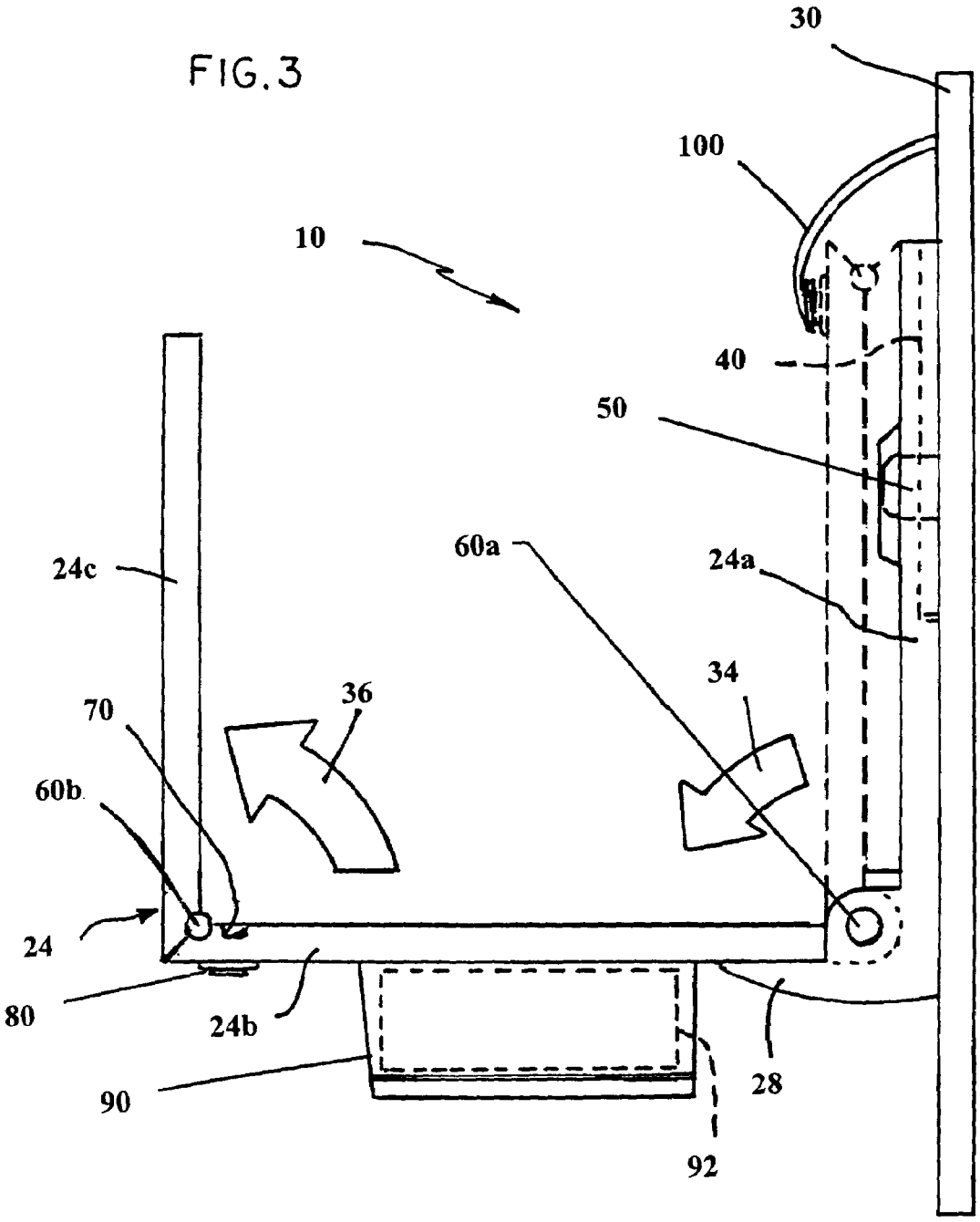
FIG. 3 is a side elevation view of the belt supported carrier of the present invention shown in the extended, or use, configuration.

Referring to FIG. 1, there is shown a perspective view of a belt supported carrier 10 shown in the extended, use configuration in accordance with the principles of the present invention. FIG. 2 is a front elevation view of the belt supported carrier 10 of the present invention shown in the retracted, or folded, configuration, while FIG. 3 is a side elevation view of the belt supported carrier shown in the extended configuration. FIG. 4 is a top plan view of the belt supported carrier 10 shown in the folded, or non-use, configuration, while FIG. 5 is a top plan view of the belt supported carrier shown in the extended configuration.

The belt supported carrier 10 includes a generally flat attachment member 30 having a pair of spaced, elongated, linear belt slots 20*a* and 20*b*. The first and second belt slots 20*a*, 20*b* are adapted to receive a belt (not shown) of a user for attaching the belt supported carrier 10 to the user's waist. Also disposed in the attachment member 30 is an elongated, linear slot 22 which is aligned generally with the first and second belt slots 20*a* and 20*b*. Disposed adjacent opposed edges of slot 22 is a ratchet mechanism 40 which includes a pair of toothed positioning rails. Inserted within the slot 22 and adapted to engage opposed teeth of the ratchet mechanism 40 is a position adjusting mechanism 50. Position adjusting mechanism 50 is preferably a spring-like device which includes a pair of spaced tabs 50*a* and 50*b* which are adapted for engagement such as by a user's thumb and index finger and which may thus be urged toward one another. When thus urged together, each of the tabs 50*a*, 50*b* is removed from engagement with one of the respective arrays of teeth permitting the tab 50 to be moved upward or downward within slot 22. When the tabs 50*a*, 50*b* are released, the spring-like structure of the position adjusting mechanism 50 causes the two tabs to again each engage a respective array of teeth. In this manner, the position adjusting mechanism 50 may be locked in fixed position within slot 22 or may freely be moved upward or downward within the slot. While tabs 50*a*, 50*b* are shown located generally adjacent the center of the attachment member 30, they may equally as well be located adjacent opposed lateral edges of the attachment member and coupled to respective ratchet engaging members by extension arms as is well known to those skilled in the arts applicable to the present invention. A forward portion of the position adjusting mechanism 50 is securely attached to a first hook element 24*a*, while an aft portion of the position adjusting mechanism engages an inner surface of attachment member 30. In this manner, the position adjusting mechanism 50 is maintained in position in slot 22 and the first hook element 24*a* is maintained in position in contact with the outer surface of the attachment member 30. First hook element 24*a* is generally planar and is disposed in contact with the outer surface of the attachment member 50. The attachment member 30 and the first hook element 24*a* are in sliding contact which permits the first hook element to be moved upward and downward on the outer surface of the attachment member. With the position adjusting mechanism 50 disposed within slot 22 and attached to the first hook element 24*a*, the first hook element may be slid along the outer surface of the attachment member 30 in a generally vertical direction upward or downward within slot 22. In addition, because the first hook element 24*a* forms part of a foldable support hook 24, which is described in detail below, the foldable support hook may also be moved in a generally vertical direction upward and downward on the outer surface of the attachment member 30.

Attached to a lower end of the first hook element 24*a* by means of a first hinge 60*a* is a second hook element 24*b*. The second hook element 24*b* is also generally planar in configuration and is pivotally displaceable between an upright position wherein the second hook element 24*b* is in closely spaced relation and parallel to the first hook element 24*a* as shown in dotted line form in FIG. 3 and a second, extended position wherein the second hook element is oriented generally perpendicular to the first hook element also as shown in FIG. 3. The lower end of the first hook element 24*a* is provided with a rotation stop 28 for engaging the second hook element 24*b* and preventing rotational displacement of the second hook element beyond 90° relative to the first hook element.

Attached to the distal end of the second hook element 24*b* by means of a second hinge 60*b* is a third hook element 24*c*. The third hook element 24*c* is also planar in configuration and can be pivotally displaced between a first position wherein the second and third hook elements are aligned parallel with one another and are in mutual contact (as shown in dotted line form in FIG. 3), and a second position wherein the third hook element is oriented generally transverse to the second hook element as shown in FIGS. 1 and 3. The first, second and third hook elements 24*a*, 24*b* and 24*c* form a foldable support hook 24 for supporting an article such as a tool, a bucket, a container of nails or screws, a roll of wire or rope, etc. A lower portion of attachment member 30 is disposed between an article supported by the inventive belt supported carrier 10 and a wearer of the carrier. For large articles, the attachment member 30 thus shields the wearer from the article being carried and prevents the article from restricting the wearer's movement or causing the wearer discomfort. The foldable support hook 24 including its first, second and third hook elements 24*a*, 24*b* and 24*c* is shown in dotted line form in the retracted position in FIG. 3. In this retracted position, the first, second and third hook elements 24*a*, 24*b* and 24*c* are aligned generally parallel to one another, with the second hook element disposed between and in contact with the first and third hook elements. To move the foldable support hook 24 from the retracted, non-use configuration to the extended, use configuration, the second hook element 24 is pivotally displaced away from the first hook element 24*a* about the first hinge 60*a* in the direction of arrow 34 shown in FIG. 3. With the second hook element 24*b* fully extended and aligned generally perpendicular to the first hook element 24*a*, the third hook element 24*c* is then pivotally displaced away from the second hook element about the second hinge 60*b* in the direction of arrow 36 as shown in FIG. 3 to a position generally perpendicular to the second hook element and parallel with the first hook element. The foldable support hook 24 may be reconfigured from the fully extended position to the retracted position by reversing the sequence of steps just described and pivotally displacing the second and third hook elements 24*b* and 24*c* in directions opposite to those of arrows 34 and 36 shown in FIG. 3.

Disposed on an upper surface of the second hook element 24*b* adjacent its distal end is an elongated, linear retaining slot 70 for receiving a portion of an article engaged and supported by the belt supported carrier 10. Thus, retaining slot 70 may be used to maintain the article being supported by the carrier 10 in a fixed position on the carrier. For example, retaining slot 70 is adapted to receive an item such as a handle attached to the article being supported, e.g., the handle of a bucket, or an elongated, linear portion of a tool which is being supported by the belt supported carrier 10. An opposed surface of the third hook element 24*c* may be provided with a similar retaining slot which is parallel to and disposed in closely spaced relation to retaining slot 70 within the second hook element 24*b* when these two hook elements are folded on one another, although this is not shown in the figures. This second slot in cooperation with positioning/retaining slot 70 would allow larger diameter articles to be positioned within the first positioning/retaining slot with the second hook element 24*b*. Disposed on the opposed surface of the second hook element 24*b* also adjacent its distal end is a retaining member 80. Retaining member 80 is adapted to securely engage a snap-acting engaging member 100 attached to an outer, upper portion of the carrier's attachment member 30 when the belt supported carrier 10 is in the folded configuration as shown in FIG. 3. Thus, with the belt supported carrier 10 in the folded, non-use configuration as shown in the front view of FIG. 2, the foldable support hook 24 is moved to the fully upraised position within the position adjusting slot 22 such that the retaining member 80 on the distal end of the second hook element 24*b* is disposed in contact with the snap-acting engaging member 100 to maintain the support hook in the fully folded configuration as shown in dotted line form in the side elevation view of FIG. 3. The support hook 24 may be released from the fully folded configuration by manually moving the flexible snap-acting engaging member 100 so that it is no longer in contact with the retaining member 80, allowing the second and third hook element 24*b* and 24*c* to be pivotally displaced about hinge 60*a* in the direction of arrow 34 as previously described.

Also disposed on the lower surface of the second hook element 24*b* when the foldable support hook 24 is in the extended, use configuration is a holder, or pouch, 90 for retaining an article such as a tape measure 92 (shown in dotted line form in FIG. 3). One end of the tape measure holder 90 is provided with an opening to allow the tape measure 92 to be removed from and inserted in the holder.

The belt supported carrier 10 of present invention is preferably comprised of a high strength, lightweight plastic material.

While particular embodiments of the present invention have been shown and described, it will be obvious to those skilled in the relevant art that changes and modifications may be made without departing from the invention in its broader aspects. For example, while adjacent elements of the foldable support hook 24 are disclosed as being oriented generally at 90° to one another, the foldable support hook may assume a wide range of shapes and configurations including that of a conventional fish hook. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus worn by a person for carrying a first article, said apparatus comprising:

an attachment member engaging and supported by a belt worn by the person;

a foldable hook structure including plural elements coupled together in a folding manner;

coupling means for pivotally connecting said hook structure to said attachment member, wherein said hook structure is moveable between a retracted, folded position, wherein said hook structure is positioned in closely spaced relation to said attachment member, and an extended, unfolded position, wherein said hook structure extends outwardly from said attachment member for engaging and supporting an article; and retaining means for connecting said attachment member and said hook structure and maintaining said hook structure in the retracted, folded position.

2. The apparatus of claim 1 wherein said retaining means includes an elongated member having a proximal end fixably attached to said attachment member and a distal end removably attached to said hook structure.

3. The apparatus of claim 1 further comprising adjustable positioning means coupling said attachment member and said hook structure for changing the position of said hook structure on said attachment member.

4. The apparatus of claim 1 wherein said attachment member includes at least one aperture for receiving a belt.

5. The apparatus of claim 4 wherein said attachment member includes a pair of spaced, aligned apertures for receiving a belt.

6. The apparatus of claim 1 further comprising retainer means attached to said hook structure for engaging and supporting a second article.

7. The apparatus of claim 6 wherein said retainer means is disposed on a lower portion of said hook structure when said hook structure is in the extended, unfolded position.

8. The apparatus of claim 7 wherein said retainer means is a pouch or a hammer sling.

9. The apparatus of claim 1 wherein said coupling means comprises a first hinge.

10. The apparatus of claim 9 wherein said hook structure includes first and second pivotally coupled hook elements.

11. The apparatus of claim 10 wherein said first hinge pivotally couples said first hook element to said attachment member, and said apparatus further comprises a second hinge pivotally coupling said first and second hook elements.

12. The apparatus of claim 10 wherein said first hook element is oriented generally transverse to said attachment member, and said second hook element is oriented generally parallel to said attachment member and extends upwardly from a distal end portion of said first hook element when said hook structure is in the extended, unfolded position.

13. The apparatus of claim 12 further comprising first and second rotation stops for respectively limiting pivoting displacement of said first hook element on said attachment member to a generally horizontal orientation and limiting pivoting displacement of said second hook element to a generally vertical orientation on said first hook element.

14. Apparatus worn by a person for carrying an article, said apparatus comprising:

an attachment member engaging and supported by a belt worn by the person;

a foldable hook structure including plural elements coupled together in a folding manner, wherein said foldable hook structure is movable between a folded, retracted configuration wherein said hook structure is positioned in closely spaced relation to said attachment member, and an unfolded, extended configuration wherein said hook structure extends outwardly from said attached member for engaging and supporting an article; and adjustable coupling means for connecting said hook structure to said attachment member and allowing the position of said hook structure to be varied vertically on said attachment member, wherein said attachment member and said hook structure are in sliding contact with said coupling means including a movable engaging member and an elongated positioning rail connected to said engaging member, and wherein said engaging member is attached to said hook structure and said positioning rail is mounted on said attachment member, and wherein said positioning rail includes an elongated linear slot having plural paired recesses disposed in a spaced manner along facing edges of said slot and said engaging member includes a pair of connected tabs urged outwardly and into engagement with a pair of aligned recesses on the edges of said slot.

15. The apparatus of claim 14 wherein said engaging member and said positioning rail comprise a ratchet.

16. The apparatus of claim 14 further comprising pivoting connecting means for attaching adjacent elements of said hook structure.

17. The apparatus of claim 16 wherein said connecting means comprises a hinge.

* * * * *